US011725549B2

(12) United States Patent
Jeon

(10) Patent No.: US 11,725,549 B2
(45) Date of Patent: Aug. 15, 2023

(54) OIL CIRCULATION SYSTEM FOR PREHEATING, LUBRICATING, AND COOLING USED FOR INTERNAL COMBUSTION ENGINE AND INDUSTRIAL FACILITY

(71) Applicant: Hyeon Cheol Jeon, Yangsan-si (KR)

(72) Inventor: Hyeon Cheol Jeon, Yangsan-si (KR)

( * ) Notice: Subject to any disclaimer, the term of this patent is extended or adjusted under 35 U.S.C. 154(b) by 0 days.

(21) Appl. No.: 17/801,309

(22) PCT Filed: Oct. 15, 2020

(86) PCT No.: PCT/KR2020/014091

§ 371 (c)(1),
(2) Date: Aug. 22, 2022

(87) PCT Pub. No.: WO2021/172687

PCT Pub. Date: Sep. 2, 2021

(65) Prior Publication Data

US 2023/0080987 A1 Mar. 16, 2023

(30) Foreign Application Priority Data

Feb. 27, 2020 (KR) ..... 10-2020-0024410

(51) Int. Cl.

| | |
|---|---|
| ***F01M 5/00*** | (2006.01) |
| ***F01M 1/02*** | (2006.01) |
| ***F01M 1/18*** | (2006.01) |
| ***F01M 11/00*** | (2006.01) |
| ***F01M 11/02*** | (2006.01) |

(52) U.S. Cl.

CPC ..... *F01M 5/005* (2013.01); *F01M 1/02* (2013.01); *F01M 1/18* (2013.01); *F01M 5/001* (2013.01); *F01M 5/002* (2013.01); *F01M 11/0004* (2013.01); *F01M 11/02* (2013.01)

(58) Field of Classification Search

CPC ..... F01M 5/005; F01M 1/02; F01M 1/18; F01M 5/002; F01M 5/001; F01M 11/0004; F01M 11/02

See application file for complete search history.

(56) References Cited

FOREIGN PATENT DOCUMENTS

| | | | | |
|---|---|---|---|---|
| JP | 05071327 A | * | 9/1991 | |
| WO | WO-9920875 A1 | * | 4/1999 | ..... F01M 11/03 |

* cited by examiner

*Primary Examiner* — Kevin A Lathers
(74) *Attorney, Agent, or Firm* — KORUS Patent, LLC; Seong Il Jeong

(57) ABSTRACT

The present invention provides a preheating, lubricating, and cooling system that oil essentially used for lubrication, wear resistance, and cooling of an internal combustion engine, industrial equipment, or a mobile vehicle is used as a preheating medium, a manager supplies the oil most optimized for load operation of equipment through a preheating system separated from the existing main oil system, and an oil supply path uses a path of the existing oil system, so that the preheating and the load operation are facilitated during an extremely cold season and an extremely hot season, and a normal operation is possible even in a case of being immediately stopped after the operation.

7 Claims, 5 Drawing Sheets

OIL CIRCULATION SYSTEM FOR PREHEATING, LUBRICATING, AND COOLING USED FOR INTERNAL COMBUSTION ENGINE AND INDUSTRIAL FACILITY

TECHNICAL FIELD

The present invention relates to an oil circulation system for preheating, lubricating, and cooling improved to increase efficiency in prior- and post-lubricating, preheating, and cooling operation for the load operation immediately after the operation, and starting a vehicle, in a self-starting, lubricating, and preheating device for an internal combustion engine or an industrial machinery.

BACKGROUND ART

In the related art, a preheating method applied to an automobile or an industrial facility depends on a method of simply preheating the self-starting engine or a drive source (generator) for a certain period of time, or simply preheating lubricating oil or hydraulic oil with external energy such as electricity, hot water, or steam. In this case, although a preparation cooling operation (cold start) is performed for stopping after the load operation, the effect is limited to relief stress, and parts such as a turbocharger that is operated at high-heat and high-rotation, which is rotated even after the engine is stopped, may not be lubricated, which causes wear or seizure.

For this reason, it is difficult for an engine that has not been operated for a long period time to perform the load operation immediately after the starting. Even if the load operation is performed, the oil is not sufficiently circulated to form an oil film on an operation friction part, which causes excessive wear. In general, it is common for a turbocharger installed on a relatively upper side to be lubricated by a self-lubricating system late after the starting. When the load operation is performed before a sufficient oil film is formed by lubrication in advance, excessive wear occurs in friction parts, bearings, and gear teeth, which are complex and sophisticated. This causes cost, time, and inconvenience in maintenance, and it is difficult to demonstrate the engine performance immediately after the starting. Therefore, a preheating operation is necessary, and a cooling operation for relieving stress and stopping after the operation is inevitable.

In particular, an emergency generator, a heavy truck, a construction machine on which a large internal combustion engine is mounted, or equipment on which a high-performance engine is mounted are very sensitive to preheating, lubricating, and stop cooling, and when such operations are failed, significant damage will occur. Therefore, in the related art, there is no other method except for the preheating operation and the cooling operation. It is difficult to demonstrate the performance by an excessive load operation and an excessive stop operation in a state in which the system is not prepared, which causes waste and problems such as excessive wear of the system, reduced lifespan, increased fumes, wasted fuel, negative influences on the environment, and lack of economic and convenience.

In recent years, in case of a diesel engine, a purification filter such as DPF, PMC, or CPF is mounted to an exhaust line to correspond the global regulations due to the environmental problems. However, a common weakness of such purification filters is that it is required to prepare for the incapability of restarting in the polar regions or extremely hot regions, or when low-speed idling is performed for cooling or heating for a long time, it is impossible to perform the load operation unless a separate recovery operation (regeneration) is performed for a considerable time due to the deterioration of the performance, that is, it is difficult to use and operate immediately, and additionally, fuel waste, environmental pollution, and time lag for the recovery operation occur. Excessive cooling and excessive heating also cause a problem in the lubrication of gears in various gear boxes, which are components of these vehicles and equipment, and hydraulic operation oil, so that a complete load operation is impossible.

As a patent document, U.S. Pat. No. 9,561,704 discloses a thermal management system including a first circulation path and a second circulation path, and capable of selectively delivering a heat transfer medium in relation to a radiator of an automobile. U.S. Pat. No. 10,124,652 discloses a vehicular thermal management system constituted by a heater that performs heating of a thermal medium and stopping of the heating, and a heat exchanger that performs a heat exchange between the thermal medium and lubricating oil used in a transmission. However, in these patent documents, the main target of the thermal management is the thermal medium made of a chemical substance, and the parts and the field to be managed are restrictive, and thus, the above problems cannot be solved.

Korea Patent Application No. 10-2017-0075211 discloses an oil preheating device for an automatic transmission including a glow plug configured to heat oil, a temperature sensor provided adjacent to the glow plug and configured to detect the temperature of the oil, and a starting sensing sensor configured to detect the starting of a vehicle, and configured such that, when the vehicle is started, the glow plug heats the oil. Korea Patent No. 10-1001073 relates to vehicular engine oil and a structure of a fuel purification and fuel preheating assembly, and discloses a structured body in which oil and fuel can flow in and flow out, a fuel flowing core body responsible for supplying the fuel to the structured body, and a fuel preheating unit in which a cooling water heat dissipation space is formed, and a cooling water flow path is formed. However, in these inventions, a heat transfer device that performs preheating quickly or a preheating device that performs a heat exchange are added based on the preheating structure according to the base method in the related art, and thus, the above problems cannot be fundamentally solved.

DISCLOSURE

Technical Problem

Therefore, it is an object of the present invention to provide an efficient preheating system used in an industrial facility, which maintains the proper air pressure during the shutdown even if the present engine (present machine) is not operated), doubles the preheating and the prior lubricating effects in a fully-charged battery condition, and provides very good preparation of the starting.

It is an object of the present invention to provide an efficient preheating system used in an industrial facility, which can reduce the inconvenience, costs, and time consumption of the related art described above, perform a load operation immediately after the starting regardless of external climates such as extreme cold in the polar regions or extreme hot in the tropics, and turn off the starting immediately after the load operation.

The present invention may be applied, for example, not only to automobiles or construction machinery, but also widely to equipment such as an emergency power generator, national defense equipment, or firefighting equipment, which have to be ready for emergency operation at an unspecified time and conditions, but are under a difficult environment due to the delay in time.

Technical Solution

In order to achieve the above object, the present invention provides a preheating, lubricating, and cooling system for an industrial facility as a preheating, lubricating, and cooling system that is connected to a driving device including an engine of the industrial facility, an internal combustion engine, or a generator, and the system includes an oil supply device configured to adjust a temperature of oil and supply the oil to the driving device along a path provided by a main oil system that supplies oil to the driving device.

The preheating, lubricating, and cooling system includes: a controller configured to control an operation of the oil supply device; a power supply unit connected to a power supply of a facility itself or an external power supply so as to supply a power; a manipulating unit constituted by a panel configured to control an operation of the controller; and a display unit configured to display a temperature indicator that displays at least the temperature of the oil.

The oil supply device includes an oil pan filled with oil, and the oil pan includes a conduit that forms a path P, an oil introducing port formed at an inlet of the conduit, a primary heater installed adjacent to the oil introducing port, a secondary heater installed to be spaced apart from the primary heater by a predetermined distance, and a circulation pump.

Inside the housing, a conduit that forms a flow path M that constitutes the main oil system and starts from a main port to be connected to the driving device, and a main oil pump installed adjacent to the main port are further mounted.

The manipulating unit includes a primary heater temperature adjusting button, a primary heater timer, a secondary heater temperature adjusting button, and a secondary heater timer, and a start (START) button that starts an operation of the circulation pump, and a stop (STOP) button that stops the operation are provided.

The manipulating unit may further include a timer that adjusts the operating cycle of the circulation pump.

When the circulation pump, the primary heater, and the secondary heater are operated, the main oil pump is maintained in a stopped state so that heated oil is supplied to the driving device through the path P to perform preheating and cooling functions, and when the main oil pump is operated, the circulation pump is maintained in a stopped state so that oil is supplied to the driving device through the path M.

When the industrial facility is immediately stopped after a load operation, the circulation pump is operated via a switch connection with a power supply mounted on the facility or an external circuit so as to perform post cooling and lubricating operation. When the driving device of the industrial facility is in a heated state, the circulation pump may be operated without heating the oil by the primary heater and the secondary heater.

The industrial facility may be representatively an automobile, a construction machine, and a generator using an internal combustion engine.

Advantageous Effects

According to the present invention, the same effect as the external electricity and air supply of the present invention may be obtained without operating the engine by mounting an external generator to mobile equipment such as a heavy truck, and cooling, heating, and other electrical equipment necessary for housing may be easily used, so that there are effects in that convenience may be promoted, noise may be reduced, fuel may be saved, and a system may be protected.

BEST MODE

The features of the embodiments of the present invention described below are in that oil essentially used for lubrication, wear resistance, and cooling of almost all equipment is used as a preheating, lubricating, and cooling medium, and a manager supplies oil that is most optimized for the load operation of each equipment through a separate preheating, lubricating, and cooling system separated from the existing main drive oil system, and at this time, the oil supply path uses the path of the existing oil system as it is.

According to the existing main drive oil system, the supplied oil is supplied, for example, to equipment such as an engine or a turbine, and the oil itself is not used as the preheating medium. However, when the oil used in the main drive oil system is used as a heating medium, and the temperature and the viscosity of the oil are controlled to be optimized for the load operation and the oil is supplied to the equipment in advance through a separate supply line to operate the equipment, it is possible to proceed directly to the load operation without any problem even under the operating conditions of extreme cold or extreme hot. For this, a preheating, lubricating, and cooling system that is totally different conceptually from the existing main drive oil system.

Hereinafter, preferred embodiments of the present invention will be described in detail with reference to the accompanying drawings.

Even though "preheating" of oil is mainly described in the description below, it should be construed as including lubricating and cooling functions in addition to the preheating. In a case of the preheating, it corresponds to "prior preheating" since the preheating is performed before the load operation, and in a case of the cooling, it corresponds to "post cooling" since the cooling means that oil cools the heated part after the load operation of the device. In a case of the "lubricating", it is to prevent the parts from being damaged by giving a wear resistance function by forming an organic film with oil, and it is maintained for relatively long time from the start of the supply of the oil.

The present invention may be widely applied to an industrial facility requiring preheating, lubricating, and cooling. Hereinafter, firstly, a mobile unit such as an automobile and an internal combustion engine will be described as an example.

Figure 1:
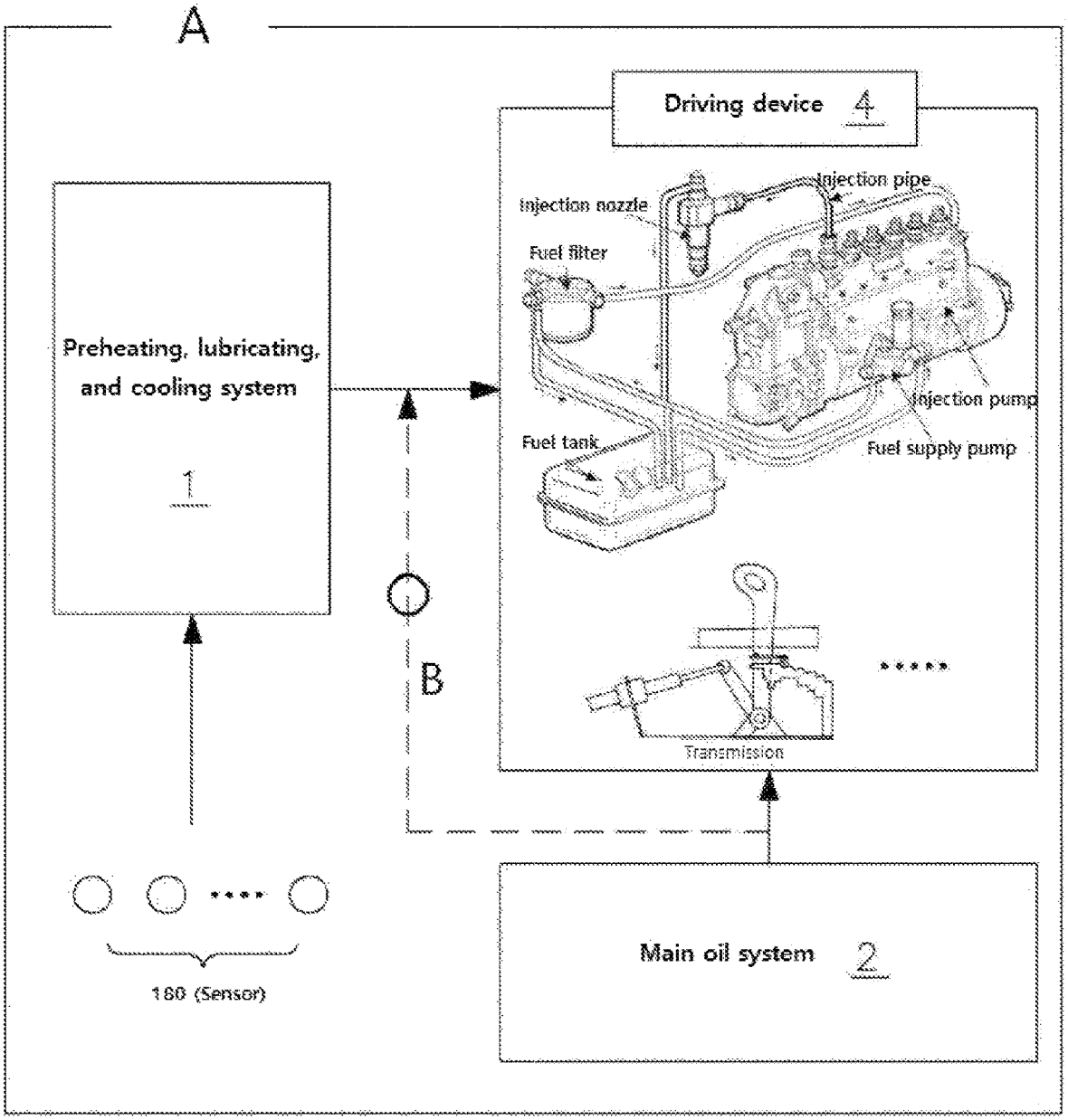
FIG. 1 is a configuration view of an entire operating system equipped with a preheating, lubricating, and cooling system according to the present invention.

FIG. 1 is a configuration view of an entire vehicle driving and operating system A equipped with a preheating, lubricating, and cooling system 1 according to the present invention. The entire system A includes the preheating, lubricating, and cooling system 1, and a driving device 4 connected to the preheating, lubricating, and cooling system 1. The driving device 4 includes all devices that may be supplied with oil, which is a heat transfer substance of the preheating, lubricating, and cooling system 1, that is, lubricating oil, and use the oil. It includes an engine, a transmission, a differential gear, a suspension, a break device. A hydraulic driving actuator of a construction machine among a mobile unit is also included in the driving device 4.

A main oil system 2 is connected to the driving device 4. The main oil system 2 means all systems that supplies oil, that is, lubricating oil to a vehicle. The main oil system 2 includes, for example, an engine oil circuit and a transmission oil circuit, but not limited thereto, and is construed as a general meaning of all systems for oil supplied for lubrication, cooling, and wear prevention of the various driving devices 4 listed above. In this aspect, it can be said that the main oil system 2 corresponds to an existing system.

One of features of the present invention is that the preheating, lubricating, and cooling system 1 uses the path of the main oil system 2 already installed as it is to supply oil to the driving device 4, and thus, the construction and the maintenance of the facility is convenience. In this sense, the preheating, lubricating, and cooling system 1 and the main oil system 2 are illustrated using an arrow B.

The preheating, lubricating, and cooling system 1 is connected to various sensors 180 installed in a vehicle. Although there are many sensors mounted to the automobile, the sensors 180 includes at least various temperature sensors related to the fuel driving.

Figure 2:
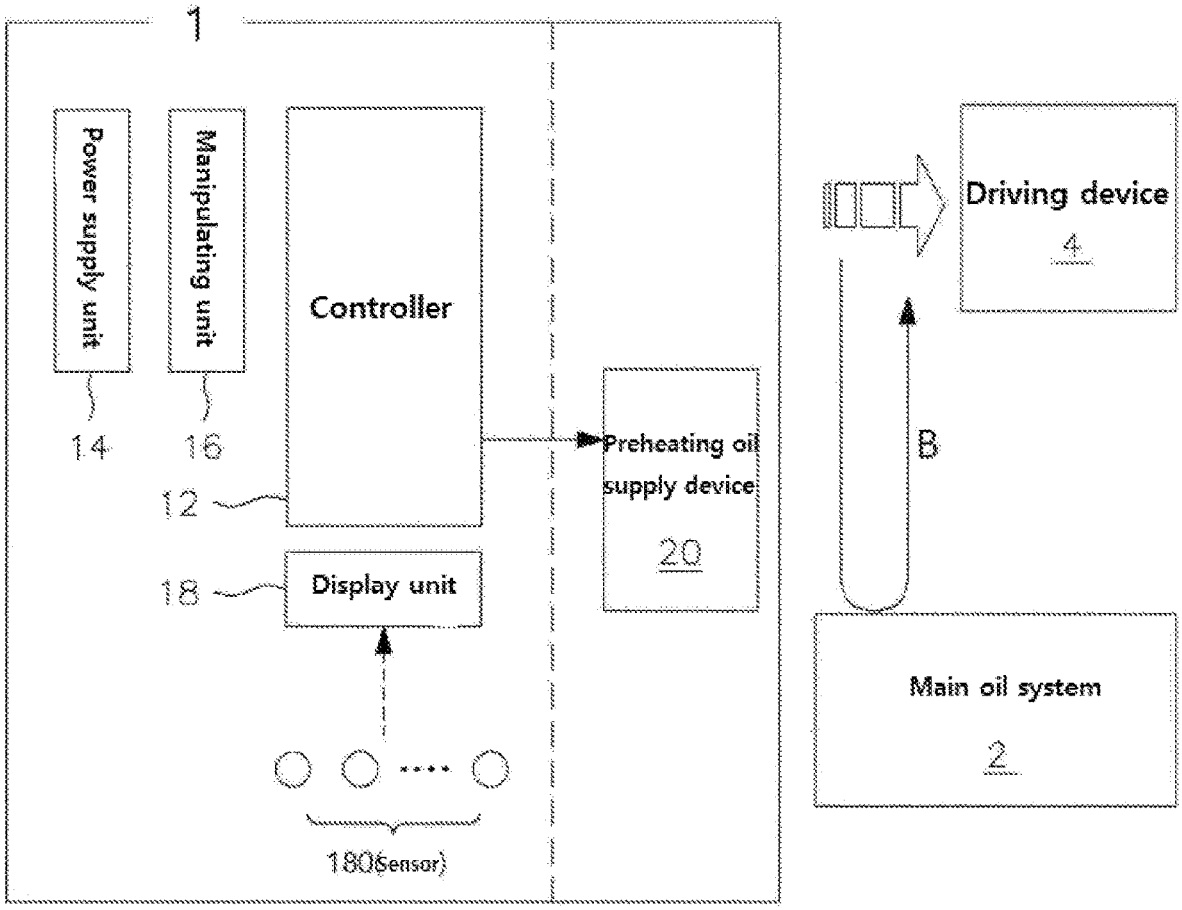
FIG. 2 is a configuration view of the preheating, lubricating, and cooling system according to the present invention.

FIG. 2 is a configuration view of the preheating, lubricating, and cooling system 1 according to the present invention.

The preheating, lubricating, and cooling system 1 according to the present invention includes a controller 12, and a power supply unit 14, a manipulating unit 16, a display unit 18, and an oil supply device 20 around the controller 12.

The power supply unit 14 includes a battery that supplies all power necessary to drive the preheating, lubricating, and cooling system 1, and is connected to an external electric power supply. The power supply unit 14 may be immediately operated by being connected to a battery charging circuit externally supplied. The power supply unit 14 may preheat not only a heater to be described later, but also an auxiliary device, other cooling water, or hydraulic oil. In mobile equipment such as a heavy truck, a small generator may be mounted, and connected to the power supply unit 14 and an air supply line.

A manager controls the controller 12 via the manipulating unit 16. The controller 12 controls the drive of the oil supply device 20 via a driving driver. As described above, the oil heated in the oil supply device 20 is supplied to the driving device 4 of the vehicle using the existing path of the oil system 2.

Figure 3:
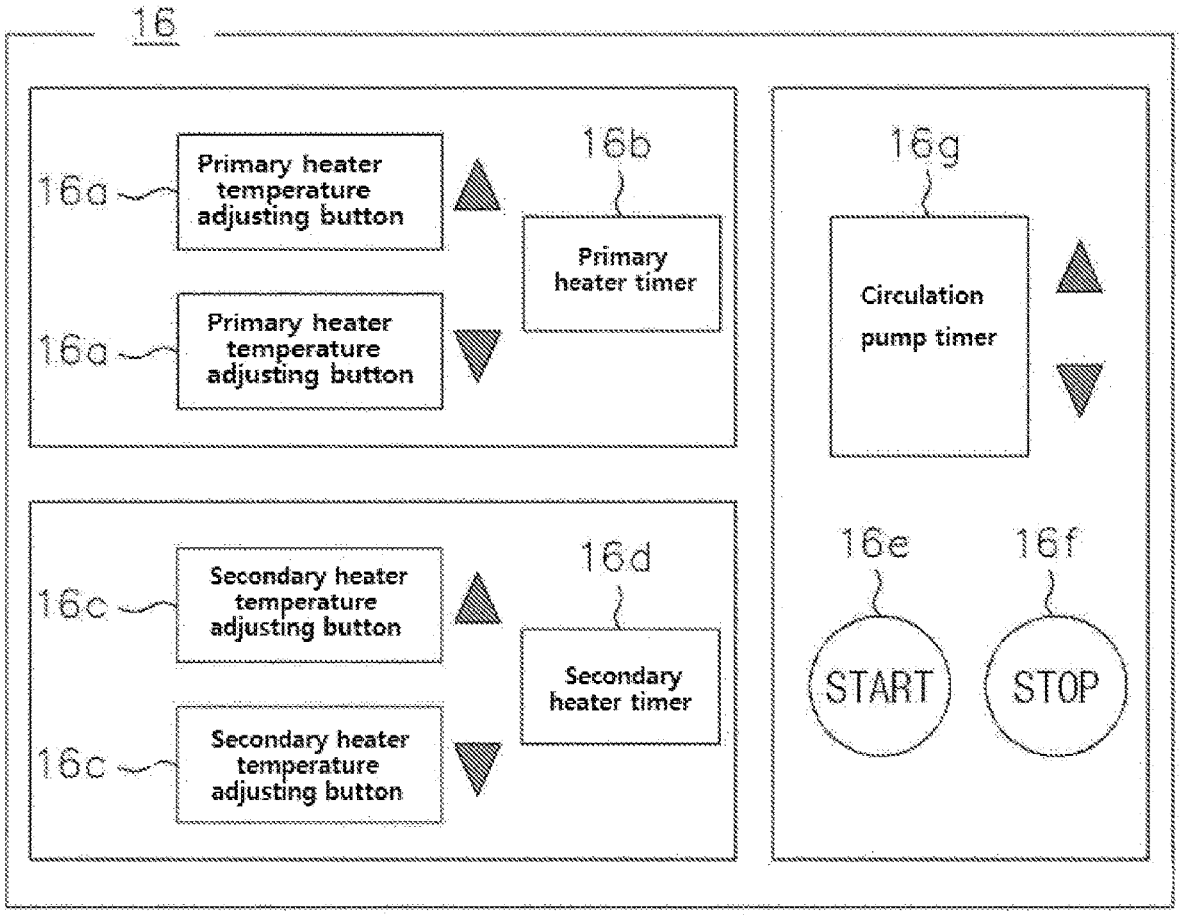
FIG. 3 is a view illustrating an example of a manipulating unit according to the present invention.

As will be described later, the oil supply device 20 according to the invention adjusts the temperature of the preheating oil via a primary heater 228 and a secondary heater 224. Therefore, as illustrated in FIG. 3, the manipulating unit 16 according to the present invention includes a primary heater temperature adjusting button 16*a*, a primary heater timer 16*b*, a secondary heater temperature adjusting button 16*c*, and a secondary heater timer 16*d*. The manipulating unit 16 is a panel type and installed adjacent to a driving seat of the vehicle.

When pushing the primary and secondary heater adjusting buttons 16*a* and 16*c* on the upper side, the current value supplied to the heat transferring wire of the primary and secondary heaters is increased so that the temperature of the preheating oil rises, and when pushing the primary and secondary heater adjusting buttons 16*a* and 16*c* on the lower side, the current value supplied to the heat transferring wire of the primary and secondary heaters is decreased so that the temperature of the preheating oil is lowered. The heating time of the primary heater is adjusted via the primary heater timer 16*b*. The heating time of the secondary heater is adjusted via the secondary heater timer 16*d*.

A start button 16*e* that starts the operation of a circulation pump 226M to be described later in the oil supply device 20, a stop button 16*f* that stops the operation, and a circulation pump timer 16*g* are installed in the manipulating unit 16. The manager controls the drive of the heater and the circulation pump so as to adjust the temperature of the oil supplied to the driving device 4 and the supply time cycle.

In a case of an automobile, it is possible to circulate oil for a constant time by operating only the circulation pump 226M by a sensor in a state where the starting is turned off. Not only an automatic driving, but also a manual driving of a manual method is possible.

Figure 4:
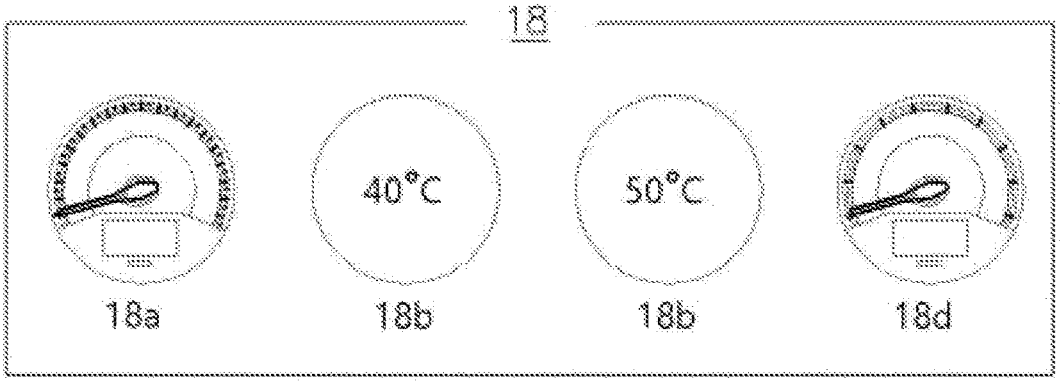
FIG. 4 is a view illustrating an example of a display unit according to the present invention.

In order for the manager to perform the above operation, information detected by the various sensors 180 mounted inside the vehicle is necessary. FIG. 4 illustrates an example of the display unit 18 according to the present invention to perform such functions. The display unit 18 is a panel type, and is installed preferably side by side the manipulating unit 16 adjacent to the driving seat of the vehicle.

The display unit 18 includes a voltage display unit 18*a* that indicates the voltage of the battery, a preheating oil temperature display unit 18*b* that indicates the current temperature of the preheating oil, a cooling water temperature display unit 18*c* that indicates the temperature of the cooling water, and an air pressure meter 18*d* that indicates the air pressure. Information is detected from the sensor 180 and is delivered to the display unit 18. The manager manipulates the panel of the manipulating unit 16 while seeing the information displayed by the display unit 18 so as to drive the oil supply device 20. The display unit 18 may further includes an indicating unit that displays a driving time cycle of the circulation pump 226M.

Figure 5:
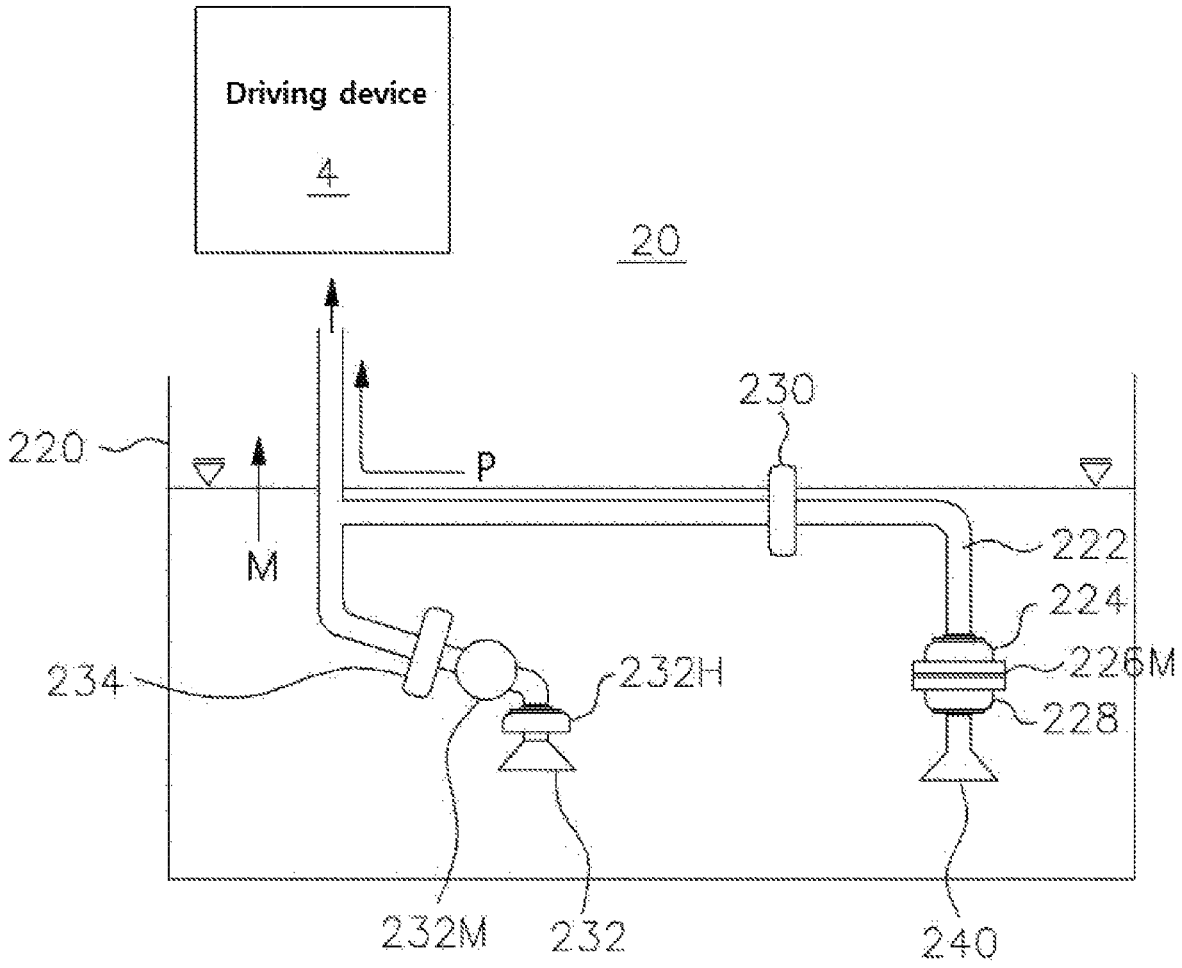
FIG. 5 is a configuration view of an oil supply device according to the present invention.

FIG. 5 is a configuration view of the oil supply device 20 according to an embodiment of the present invention. Although it is indicated as the oil supply device 20, it should be construed as a device in a broad sense including not only the preheating, but also the lubricating by forming an oil film and the cooling function after the operation.

The exterior of the oil supply device 20 is formed by an oil pan 220 filled with oil. The flow path M started from a main port 232 to be connected to the driving device 4 constitutes a part of the oil system 2 described above. In this aspect, it may be said that the preheating, lubricating, and cooling system 1 and a part of the main oil system 2 are physically positioned in a same space, but it should be noted that those are conceptually clearly distinguished from each other. The supply paths of the operation main oil supplied to the engine, the transmission, or the differential gear are installed independent of each other in the vehicle, a plurality of oil supply devices 20 including the oil pan 220 is installed with the same configuration. A check valve 234 installed in the flow path M is installed to prevent the reverse flow of the oil. Further, a main oil pump 232M is mounted in the upper portion adjacent to a main port 232. The main oil pump 232M is driven in a conventional manner by the load operation as is well known. A third heater 232H is installed in the lower portion of the main oil pump 232M. The third heater 232H is configured to increase the temperature of the main oil and supply to the driving device 4, and may be manipulated automatically or manually.

The features of the present invention are a conduit 222 that forms a preheating, lubricating, and cooling path P, an oil introducing port 240 formed in an inlet of the conduit 222, the primary heater 228 installed in the upper portion adjacent to the oil introducing port 240, the secondary heater 224 installed to be spaced apart from the primary heater 228 by a predetermined distance, and the circulation pump 226M installed between the primary heater 228 and the secondary heater 224. The primary and secondary heaters 228 and 224 include a heat transferring wire, and are connected to a power supply (not illustrated).

As described above, the circulation pump 226M may be set the operation cycle and time thereof, and may be connected to a self-manipulating switch and a distributor inside the equipment.

The check valve 230 installed in the flow path P is installed to prevent the reverse flow of the oil, but in order to be integrated with the check valve 234, for example, a three-way valve, which is electromagnetically driven, may be installed at a junction where the two paths M and P intersect. When the circulation pump 226M is driven, the oil is introduced through the oil introducing port 240, passes through the primary heater 228 and the secondary heater 224 in sequence to be heated, and is supplied to the driving device 4. During the heating operation, the primary heater 228 is essentially used, and the secondary heater 224 may be selectively used to further increase the temperature of the oil. As described above, the manager can control the temperature of the oil supplied to the driving device 4 and the supply time cycle by controlling the temperature of the primary heater 228 and the secondary heater 224, the heating time, and the driving cycle of the circulation pump 226M using the manipulating unit 16 while checking the temperature of the oil via the display unit 18 or receiving a feedback. The heated oil passed through the check valve 230 is supplied to each driving device 4 along the path already supplied by the main oil system 1, and the inside of each facility is heated, lubricated, and cooled while the temperature and the heating circulation cycle are adjusted by the manager.

In the above, a case where the preheating, lubricating, and cooling system 1 and a part of the main oil system 2 are accommodated in the same oil pan 220 has been described. However, it is possible to construct the independent oil supply device 20 by separating the configuration that constitutes the path P.

The lubricating and cooling at the time of the immediately stop after the load operation of the vehicle may be directly driven by a circulation pump manipulating switch inside or outside of the equipment, and an automatic circulation is possible for a constant time.

Based on the above description, an operation principle according to an embodiment of the present invention will be described.

First, when performing the preheating while being stopped, the power supply unit 14 is connected to external supply equipment to be operated. At this time, the switch of the manipulating unit 16 and each dashboard of the display unit 18 are connected to the power supply at the same time. The power is applied to the primary heater 228 and the secondary heater 224, and if necessary, the transmission, a hydraulic oil tank, the differential gear, or other components via the external switch. When the external power supply is not used, the battery or the generator built in the equipment may be used. Subsequently, the circulation pump 226M is driven by using the switch, and the operation time cycle is adjusted. Of course, it is possible to automatically maintain the temperature set through a simple circuit configuration.

Since the oil pump 232M is in a stopped state when the circulation pump 226M is operated, the oil flows through the path P, and does not flow reversely to the main oil system 2 due to the check valve 234. The supplied oil, which is heated, performs the prior preheating function and also the lubricating function due to the formation of the oil film. As a result, an optimum state prepared for the load operation after the starting is established, and after the load operation, the lubricating and cooling function are continuously performed.

When the main oil pump 232M is operated after the starting, the circulation pump 226M is turned off to stop the operation, and the oil does not flow reversely to the preheating, lubricating, and cooling system 1 due to the check valve 230. If necessary, the third heater 232H is driven to reduce the temperature difference with the oil that is already supplied and heated in a state where the starting is turned off, and thus, the load operation can be performed more smoothly. The oil supplied by the main oil pump 232M is delivered to the driving device 4 and performs the functions as already well known.

Further, when an external battery charging circuit and the air pressure is corrected, the starting is further facilitated. Due to the interlocking operation of these preheating and the circulation, the load operation immediately after the starting is possible.

Next, when it is immediately stopped after the load operation, the circulation pump 226M may be operated similarly to the normal case via a switch connection with a power supply mounted on the equipment or an external circuit. By considering the temperature and the ambient conditions, it is possible to automatically enable for a constant time immediately after the starting is turned off, and each part of the high-temperature engine may be lubricated and cooled through this.

As described above, when the internal combustion engine is in a cooled state in a state of being not operated, the oil is heated through the primary and secondary heaters. However, when there is enough heat in the internal combustion engine, when the oil is supplied while the primary and secondary heaters do not heat and only the circulation pump 226M is operated, the preheating function may be automatically performed and, at the same time, the oil film may be formed.

Figure 6:
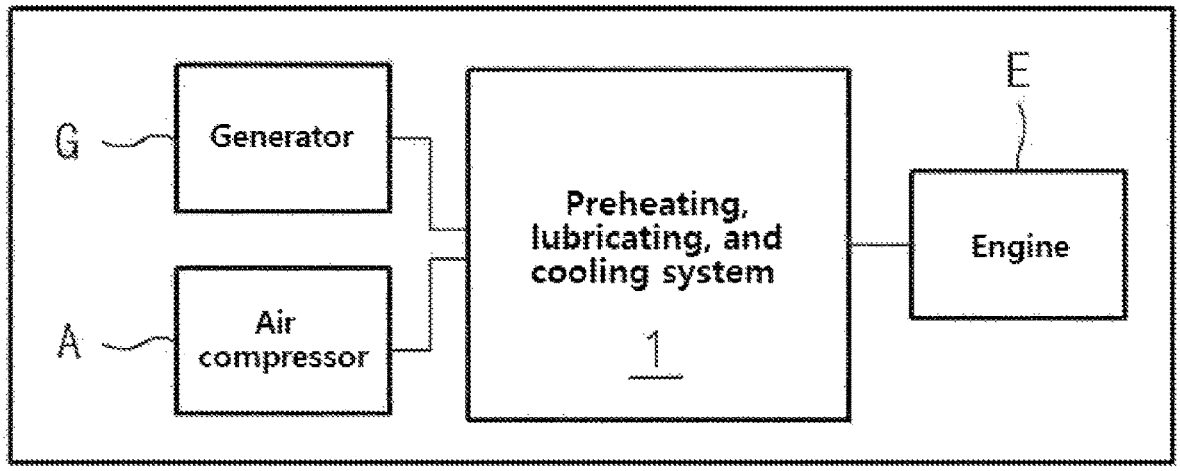
FIG. 6 is a configuration view of an entire operating system equipped with a preheating, lubricating, and cooling system according to another example of the present invention.

Next, FIG. 6 illustrates a configuration view in a case where the preheating, lubricating, and cooling system 1 is applied not to the mobile unit, but the industrial facility, which is a fixed station, for example, a power plant, a production plant, or a large building equipped with a large driving unit such as an engine. The preheating, lubricating, and cooling system 1 according to the present invention is supplied with the power via a mounted generator G, is connected to an air compressor A to preheat and lubricate an engine E, which is the driving unit 4, and performs the load operation, and then, performs the cooling function the lubricating, and the load operation. An air pressure sensor is connected to the preheating, lubricating, and cooling system 1, and the air pressure is used as a reference for the oil supply. The oil is supplied to the driving device including the engine via a so-called "distribution sharing device".

In the above, some embodiments have been described mainly illustrating a mobile unit such as an automobile and a construction machine as an example, the features of the present invention are in that oil essentially used for lubrication, wear resistance, and cooling of almost all equipment including an internal combustion engine type generator is used as a preheating medium, a manager supplies the oil most optimized for load operation of each equipment through a separate preheating system separated from the existing main drive oil system, and a flow path system uses the existing main drive oil system as it is.

Various modifications are possible to the present invention without departing from the basic spirit of the present invention. Such modifications are also within the scope of the present invention, and it is obvious that the scope of the present invention extends to the same or equivalent scope as the claims described below.

What is claimed is:

1. A preheating, lubricating, and cooling system for an industrial facility that is connected to a driving device including an engine of the industrial facility or a generator, the preheating, lubricating, and cooling system comprising: an oil supply device configured to adjust a temperature of oil and supply the oil to the driving device along a path provided by a main oil system that supplies oil to the driving device; and the preheating, lubricating, and cooling system for the industrial facility further comprising: a controller configured to control an operation of the oil supply device; a power supply unit connected to a power supply of a facility itself or an external power supply so as to supply a power; a manipulating unit constituted by a panel configured to control an operation of the controller; and a display unit configured to display a temperature indicator that displays at least the temperature of the oil, wherein the oil supply device includes an oil pan filled with oil, and the oil pan includes a conduit that forms a path P, an oil introducing port formed at an inlet of the conduit, a primary heater installed adjacent to the oil introducing port, a secondary heater installed to be spaced apart from the primary heater by a predetermined distance, and a circulation pump, the manipulating unit includes a primary heater temperature adjusting button, a primary heater timer, a secondary heater temperature adjusting button, and a secondary heater timer, a start (START) button that starts an operation of the circulation pump, a stop (STOP) button that stops the operation, and a circulation pump timer that sets an operation time cycle of the circulation pump.

2. The preheating, lubricating, and cooling system for the industrial facility according to claim 1, wherein, inside the oil pan, a conduit that forms a flow path M that constitutes the main oil system and starts from a main port to be connected to the driving device, a main oil pump installed adjacent to the main port, and a third heater are mounted.

3. The preheating, lubricating, and cooling system for the industrial facility according to claim 2, wherein, when the circulation pump is operated, the main oil pump is maintained in a stopped state so that heated oil is supplied to the driving device through the path P to perform preheating and lubricating functions, and when the main oil pump is operated, the circulation pump is maintained in a stopped state so that main oil is supplied to the driving device through the flow path M.

4. The preheating, lubricating, and cooling system for the industrial facility according to claim 2, wherein, when the industrial facility is immediately stopped after a load operation, the circulation pump is operated via a switch connection with a power supply mounted on the facility or an external circuit.

5. The preheating, lubricating, and cooling system for the industrial facility according to claim 4, wherein, when the driving device of the industrial facility is in a heated state, the circulation pump is operated without heating the oil by the primary heater and the secondary heater.

6. A preheating, lubricating, and cooling system for an automobile that is connected to a driving device including an engine, a transmission, and a differential gear of the automobile, the preheating, lubricating, and cooling system comprising: an oil supply device configured to adjust a temperature of oil and supply the oil to the driving device along a path provided by a main oil system that supplies oil to the driving device; and the preheating, lubricating, and cooling system comprising: a controller configured to control an operation of the oil supply device; a power supply unit connected to a power supply of a facility itself or an external power supply so as to supply a power; a manipulating unit constituted by a panel configured to control an operation of the controller; and a display unit configured to display a temperature indicator that displays at least the temperature of the oil, wherein the oil supply device includes an oil pan filled with oil, and the oil pan includes a conduit that forms a path P, an oil introducing port formed at an inlet of the conduit, a primary heater installed adjacent to the oil introducing port, a secondary heater installed to be spaced apart from the primary heater by a predetermined distance, and a circulation pump, the manipulating unit includes a primary heater temperature adjusting button, a primary heater timer, a secondary heater temperature adjusting button, and a secondary heater timer, a start (START) button that starts an operation of the circulation pump, a stop (STOP) button that stops the operation, and a circulation pump timer that sets an operation time cycle of the circulation pump.

7. The preheating, lubricating, and cooling system for the automobile according to claim 6, wherein inside the oil pan, a conduit that forms a flow path M that constitutes the main oil system and starts from a main port to be connected to the driving device and a main oil pump installed adjacent to the main port are further mounted, when the circulation pump is operated, the main oil pump is maintained in a stopped state so that heated oil is supplied to the driving device through the path P to perform preheating and lubricating functions, and when the main oil pump is operated, the circulation pump is maintained in a stopped state so that main oil is supplied to the driving device through the path M.

* * * * *